US005921762A

United States Patent [19]

Chang et al.

[11] Patent Number: 5,921,762

[45] Date of Patent: Jul. 13, 1999

[54] OLDHAM RING SYSTEM FOR ROTARY FLUID APPARATUS

[75] Inventors: Yu-Choung Chang; Chih-Cheng Yang; Tse-Liang Hsiao; Ching-Feng Lai; Kun-I Liang; Su Tao, all of Hsinchu, Taiwan

[73] Assignee: Industrial Technology Research Institute, Hsinchu, Taiwan

[21] Appl. No.: 08/668,150

[22] Filed: Jun. 21, 1996

[51] Int. Cl.[6] ..... F01C 1/04

[52] U.S. Cl. ..... 418/55.3; 418/94; 464/104

[58] Field of Search ..... 418/55.3, 55.6, 418/94; 464/102, 104

[56] References Cited

U.S. PATENT DOCUMENTS 5,395,220 3/1995 Miura et al. ..... 418/55.3
5,582,512 12/1996 Bush ..... 418/55.3

FOREIGN PATENT DOCUMENTS 227885 9/1989 Japan ..... 418/55.3
4342889 11/1992 Japan ..... 418/55.6

*Primary Examiner*—Charles G. Freay
*Attorney, Agent, or Firm*—W. Wayne Liauh

[57] ABSTRACT

An Oldham ring system for a rotary fluid compressor, comprising: a motor shaft; an eccentric shaft; a revolving part with two first gliding elements on its lower side; a stator; an Oldham ring, its upper side being provided with two second gliding elements fitting the two first gliding elements, and its lower side being provided with two third gliding elements for a perpendicular gliding movement; and a frame, on its perimeter being provided with two holders and with two fourth gliding elements in between that glide against said third gliding elements; wherein the characteristic is that the Oldham ring is, on the two opposite sides located next to the holders of the frame, provided with two straight shortcuts to reduce the width of the Oldham ring next to the holders; and wherein the first and second gliding elements as well as the third and fourth gliding elements each are provided with a groove in the gliding direction to provide for a flow path for lubricating oil.

6 Claims, 9 Drawing Sheets

OLDHAM RING SYSTEM FOR ROTARY FLUID APPARATUS

TECHNICAL FIELD

This invention relates to an Oldham ring system for a rotary fluid compressor, particularly to an improvement of the shape of the Oldham ring, in order to decrease the size of the rotary fluid compressor, while Oldham ring and frame will glide against each other on a maximum surface.

BACKGROUND ART

Basically a rotary fluid compressor performs the steps of drawing in, compressing and pushing out fluid by means of a motor driving an eccentric shaft, letting a revolving part engage with a stator. In order to allow for a proper relative movement of the revolving part and the stator, an Oldham ring is used to ensure a circling movement of the revolving part around the stator's center without the revolving part rotating itself. When the revolving part circles around as driven by the eccentric shaft, it will move to and fro gliding along the Oldham ring's transverse axis. At the same time the Oldham ring carries out a longitudinal movement back and forth along a gliding path of the frame, in accordance with the revolving part's displacement.

As shown in FIGS. 8 and 9, a conventional Oldham ring 4 is a ring that is mounted between the revolving part and the frame 5. It performs a movement back and forth separately against the revolving part and the frame. While it moves back and forth, in order to prevent the revolving part and the frame from interfering with the fastening device 6 used to attach other machine elements, the frame's 5 outer diameter has to be increased, such that the fastening device 6 will not collide with the movement back and forth of the Oldham ring 4. Then, in order to accommodate the larger outer diameter of the frame 5, the size of the compressor's housing has to be enlarged and the compressor cannot be built compact.

On the Oldham ring 4, gliding parts 7 for the movements back and forth glide against the revolving part and the frame 5 to prevent the revolving part from rotating. The gliding parts 7 almost act like seals, so lubricating oil between the Oldham ring 4 on the one hand and the revolving part and the frame 5 on the other hand cannot be taken in by the fast moving gliding parts 7. This causes oil pressure, leading to impaired oil flow and energy loss.

SUMMARY OF THE INVENTION

An objective of this invention consists in providing an Oldham ring for a rotary fluid compressor, which, without enlarging the compressor's size, maximizes the contact surface of the frame to reduce the pressure of the revolving part on the frame.

A further objective of this invention consists in providing an Oldham ring for a rotary fluid compressor of compact size.

A further objective of this invention consists in providing an Oldham ring for a rotary fluid compressor, wherein the pressure of lubricating oil will be reduced during operation.

These objectives as well as further advantages will become apparent by the following description and claims, taken in conjunction with the accompanying drawings.

BEST MODE TO CARRY OUT THE INVENTION

Figure 1:
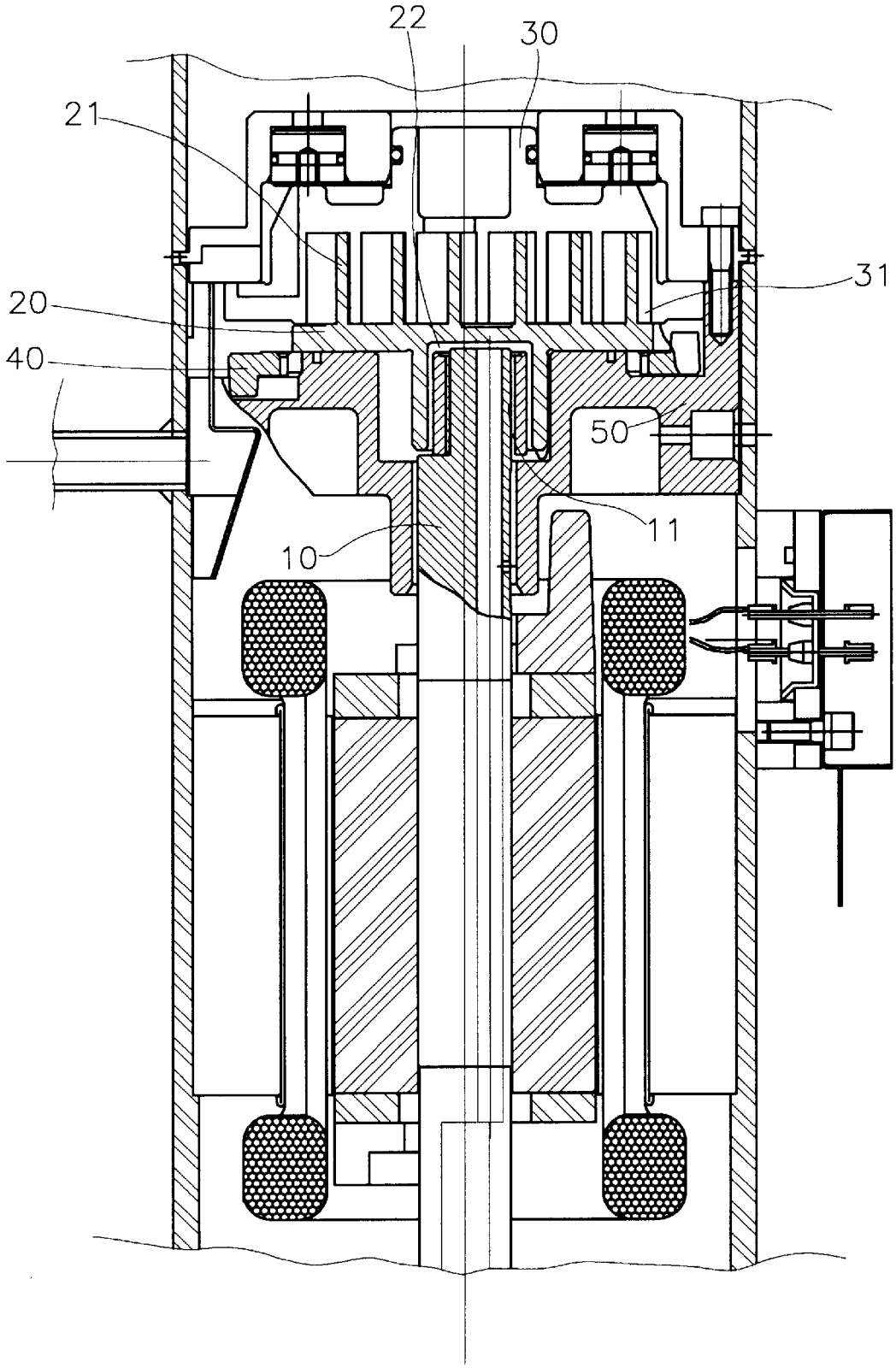
FIG. 1 is a schematic illustration of the operation of this invention's compressor to show the location of each structural element.

As shown in all figures, this invention's Oldham ring for a rotary fluid compressor is used in a structure where a motor 10 drives the rotatory movement of an eccentric shaft 11, causing a movement of a revolving part 20 engaged with a stator 30. Due to the restriction by an Oldham ring 40 the revolving part 20 does not rotate itself, but rather revolves around the stator's 30 center.

As shown in FIG. 1, the eccentric shaft 11 is mounted on the motor shaft keeping a certain distance from its axis. Correspondingly the eccentric shaft 11 carries out an eccentric revolving movement, as driven by the motor shaft. The revolving part 20 is connected to the eccentric shaft 11, such that the revolving part 20 follows the eccentric revolving movement of the eccentric shaft 11.

The revolving part 20 is roughly shaped like a disk. On the lower side of the revolving part 20 there is an opening 22, which is enclosed by a downward extending wall and used to loosely connect to the eccentric shaft 11. Thereby the revolving part 20 follows the revolving movement of the eccentric shaft 11. On the upper side of the revolving part 20 several upward extending revolving part blades 21 are mounted, which are surrounded by the stator 30 and engage with it. The revolving part 20 has on its lower side, opposite to each other, two first gliding elements 23 to be enclosed by the Oldham ring 40. When the revolving part 20 follows the eccentric revolving movement of the eccentric shaft 11, the resulting displacement in transverse direction (perpendicular to the Oldham ring's longitudinal axis) will be against the Oldham ring 40.

Figure 5:
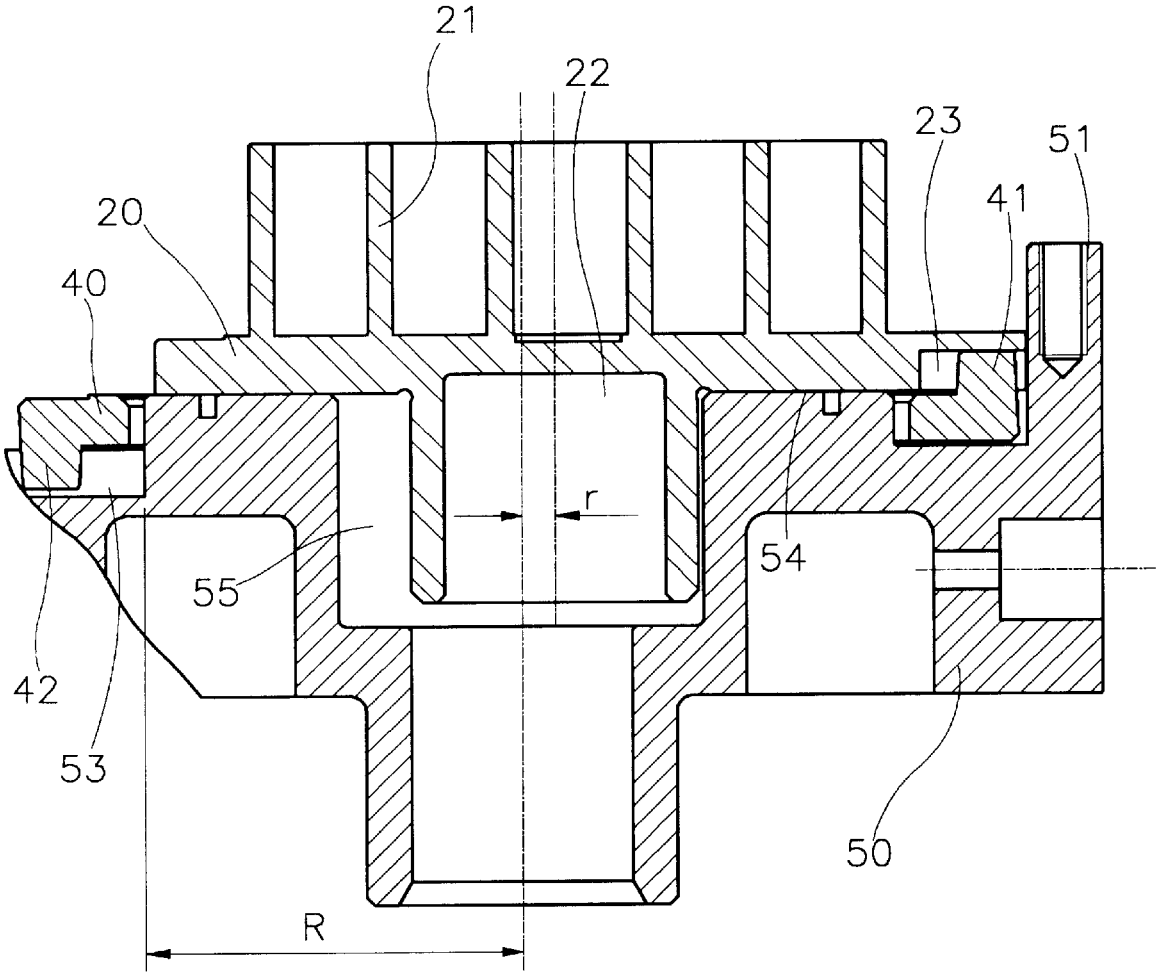
FIG. 5 is an illustration of the relative positions of the revolving part, the Oldham ring and the frame of this invention.

As shown if FIGS. 1 and 5, the stator 30 is roughly shaped like a disk. On the lower side of the stator 30 several downward extending stator blades 31 are mounted, which correspond to the revolving part blades 21 and surround them to form several enclosed spaces for fluid. When the revolving part 20 encircles around, the revolving part blades 21 will engage with the stator blades 31 and generate pressure. (Generating pressure by mutual engaging revolving part blades and stator blades is a well-known process and so will not be discussed in detail here.)

Figure 2:
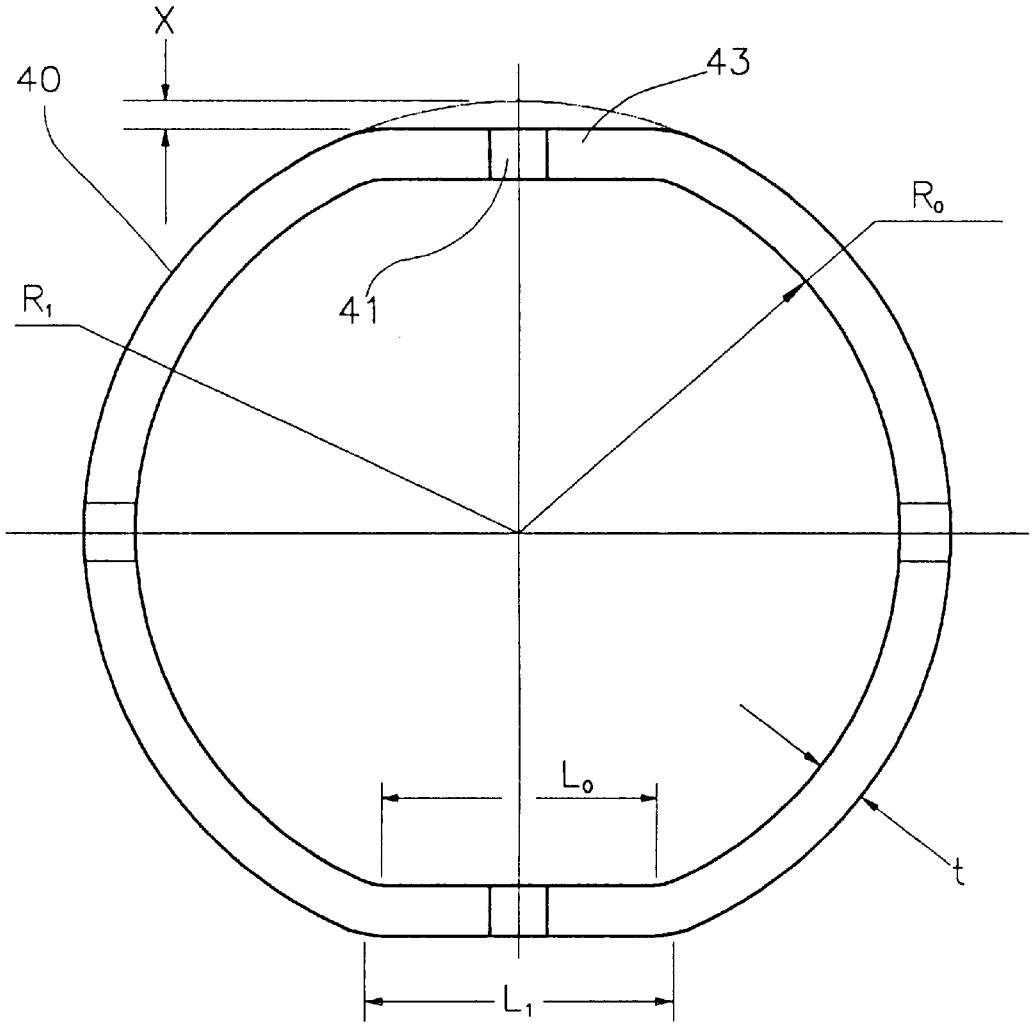
FIG. 2 is a top view of this invention's Oldham ring to show the shape of this invention's Oldham ring.
Figure 3:
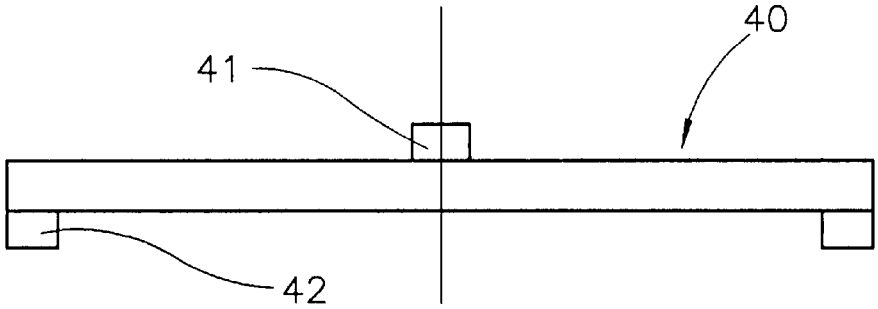
FIG. 3 is an elevational view of this invention's Oldham ring.

As shown in FIGS. 2 and 3, the Oldham ring 40 is roughly shaped like a circular ring with a longitudinal and transverse axis. It is mounted on the lower side of the revolving part 20 close to its perimeter. On the upper side of the Oldham ring 40 there are, along the transverse axis, opposite to each other, two second gliding elements 41, mounted corresponding to the two first gliding slots 23 of the revolving part 20. Thus the revolving movement of the revolving part 20 is, by way of the confinement due to the first gilding slots 23 and second gliding elements 41, at the same time a transverse movement to and fro against the Oldham ring. On the lower side of the Oldham ring 40 there are, along the longitudinal axis, opposite to each other, two third gliding elements 42, enclosed by a frame 50. There purpose is to allow the Oldham ring 40 to carry out a movement in its longitudinal direction against the frame 50.

Figure 4:
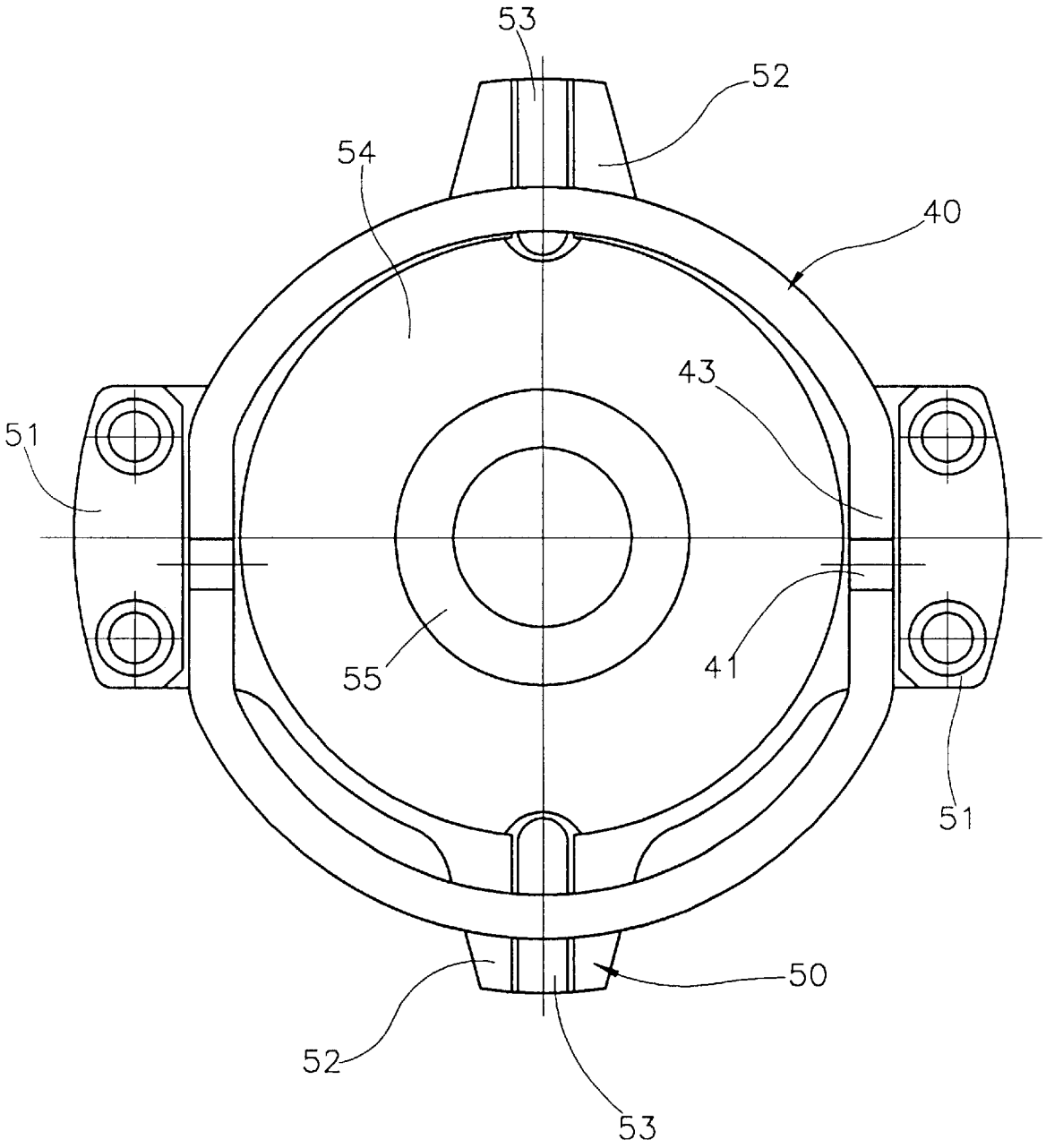
FIG. 4 is a schematic illustration of this invention's Oldham ring together with the frame to show the relative positions of the Oldham ring and the frame.

As shown in FIGS. 4 and 5, the frame 50 is roughly a disk-shaped support. The center of the frame has a hole 55 to accommodate the eccentric movement of the eccentric shaft 11, such that the frame 50 will not interfere with this movement. Around the hole 55 the top side of the frame 50 protrudes to form a planar inner support 54. The inner support 54 is in contact with the bottom side of the revolving part 20 to support the revolving part 20. By way of its own downward pressure the revolving part 20 sits tightly below the stator 30 to perform the task of compressing fluid.

On its top side on the outer edge the frame 50 is provided with two holders 51, located opposite to each other along the transverse axis of the Oldham ring, to fasten any structural elements needed in the compressor. Between the two holders 51 and the inner support 54 a flange support 52 is cut in to support the Oldham ring 40. The Oldham ring 40 glides on the ring-like support 52. The ring-like support 52 is further provided with two fourth gliding slots 53, located opposite to each other along the longitudinal axis of the Oldham ring. The two fourth gliding elements 53 accommodate the two third gliding elements 42 of the Oldham ring 40. So the movement of the Oldham ring 40 against the ring-like support 52 is restricted to a movement back and forth along the longitudinal direction of the Oldham ring 40.

Next to the two holders 51 the Oldham ring is shortcut by two straight sections 43, which are parallel to the Oldham ring's longitudinal axis and the two third gliding elements 42. The two straight sections 43 fit into the space between the two holders 51 and the inner support 54 and allow the Oldham ring 40 to glide back and forth along its longitudinal direction without interfering with the two holders 51.

The Oldham ring's 40 movement is determined by the following:

Let the inner radius of the Oldham ring's 40 circular sectors be $R_0$, the eccentricity of the eccentric shaft 11 be r, and the outer radius of the inner support 54 be $R_t$. Then $R_0=R_t+r$ should hold. $R_0$ may be increased by a small extra amount to prevent the Oldham ring 40 from colliding with the perimeter of the inner support 54, when moving fast.

The outer radius of the Oldham ring's 40 circular sectors is $R_1=R_t+r+t$, where t is the width of the Oldham ring's 40 circular sectors.

The length of the Oldham ring's 40 straight section 43 on the inner side is $L_0=2\sqrt{R_0^2-(R_0-X)^2}$, where $0<X\leqq R_0-R_t$.

The length of the Oldham ring's 40 straight section 43 on the outer side is $L_1=2\sqrt{R_1^2-(R_1-X)^2}$, where $0<X\leqq R_0-R_t$.

X is the amount by which each of the Oldham ring's 40 two straight sections 43 reduces the transverse extension of the Oldham ring 40.

Since the Oldham ring 40 carries out a movement back and forth along its longitudinal axis only, it has the two straight sections 43 to minimize its transverse extension to a value where the Oldham ring 40 still does not collide with the inner support 54 while moving back and forth. Therefore, with the distance of the holders 51 of the frame 50 determined by the inner diameter of the compressor, the diameter of the Oldham ring 40 can be made larger than the diameter of a conventional Oldham ring, and the Oldham ring 40 will still not interfere with the holders 51 while moving back and forth. So the inner support 54 of the frame 50 can be made larger, exhibiting an increased surface to carry the revolving part 20 and reducing the pressure of the revolving part 20 on the inner support 54.

Figure 6A:
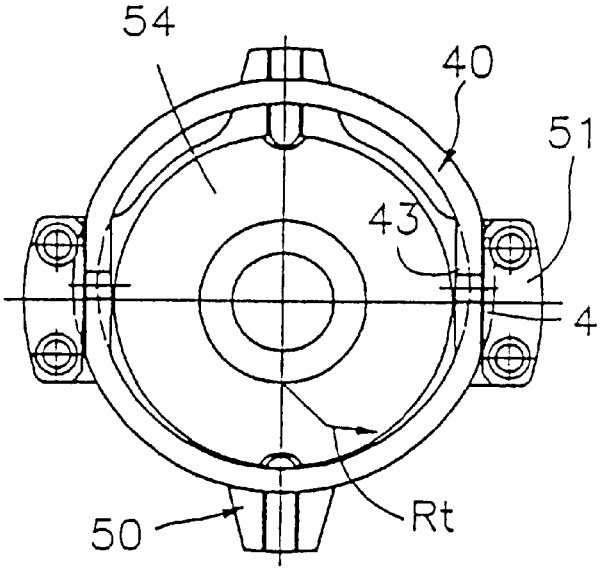
FIG. 6 is a schematic illustration of the movement of this invention's Oldham ring relative to the frame to show the gliding of the Oldham ring against the frame.
Figure 6B:
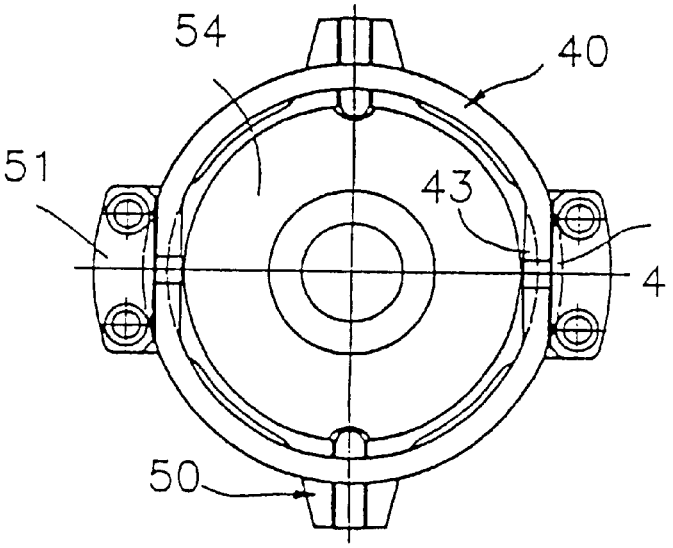
Figure 6C:
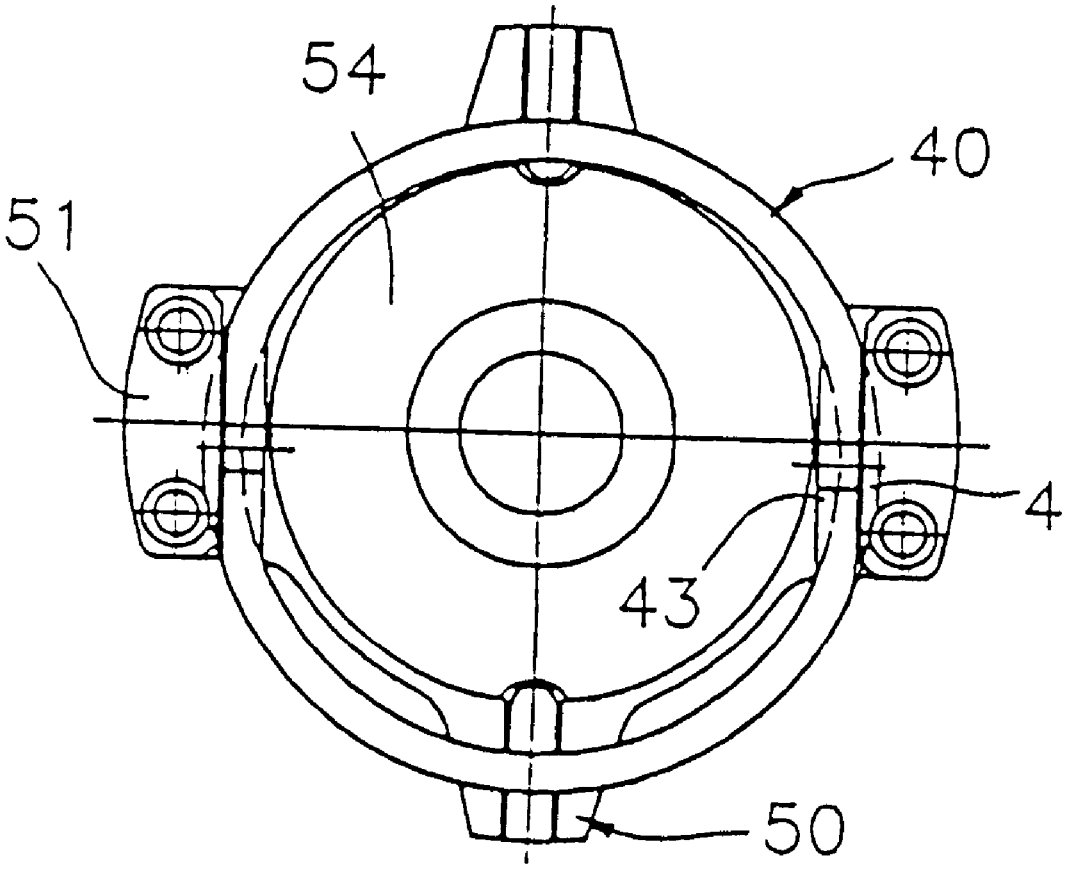

As shown in FIG. 6, the straight sections 43 of the Oldham ring 40, which are adapted to the holders 51 of the frame 50, allow to reduce the width of the Oldham ring 40 between the holders 51. So with a given are of the inner support 54 of the frame 50, it is not necessary, as with the conventional design of Oldham rings, to enlarge the size of the frame 50 in order to avoid a collision of the Oldham ring and the holder. This allows for a compact structure of the rotary compressor's housing. At the same time, the Oldham ring 40 is basically of circular shape, allowing for efficient mass-production.

Figure 7:
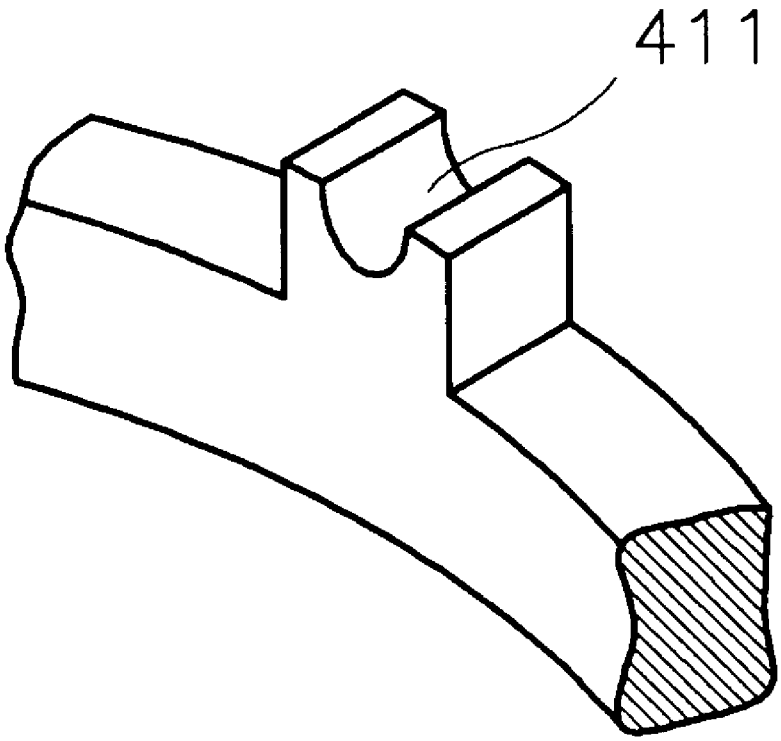
FIG. 7 is a three-dimensional view of the gliding part of this invention's Oldham ring.
Figure 8:
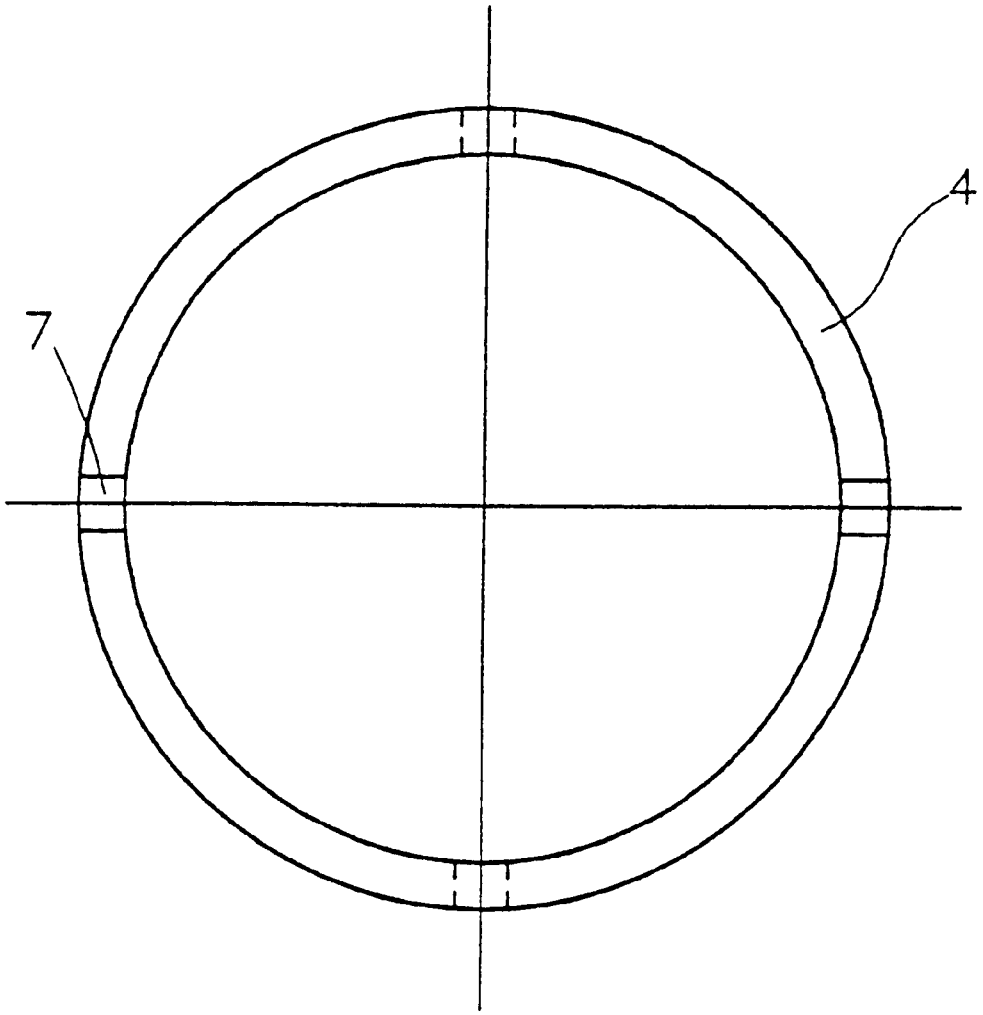
(PRIOR ART) FIG 8
FIG. 8 is a top view of a conventional Oldham ring.
Figure 9:
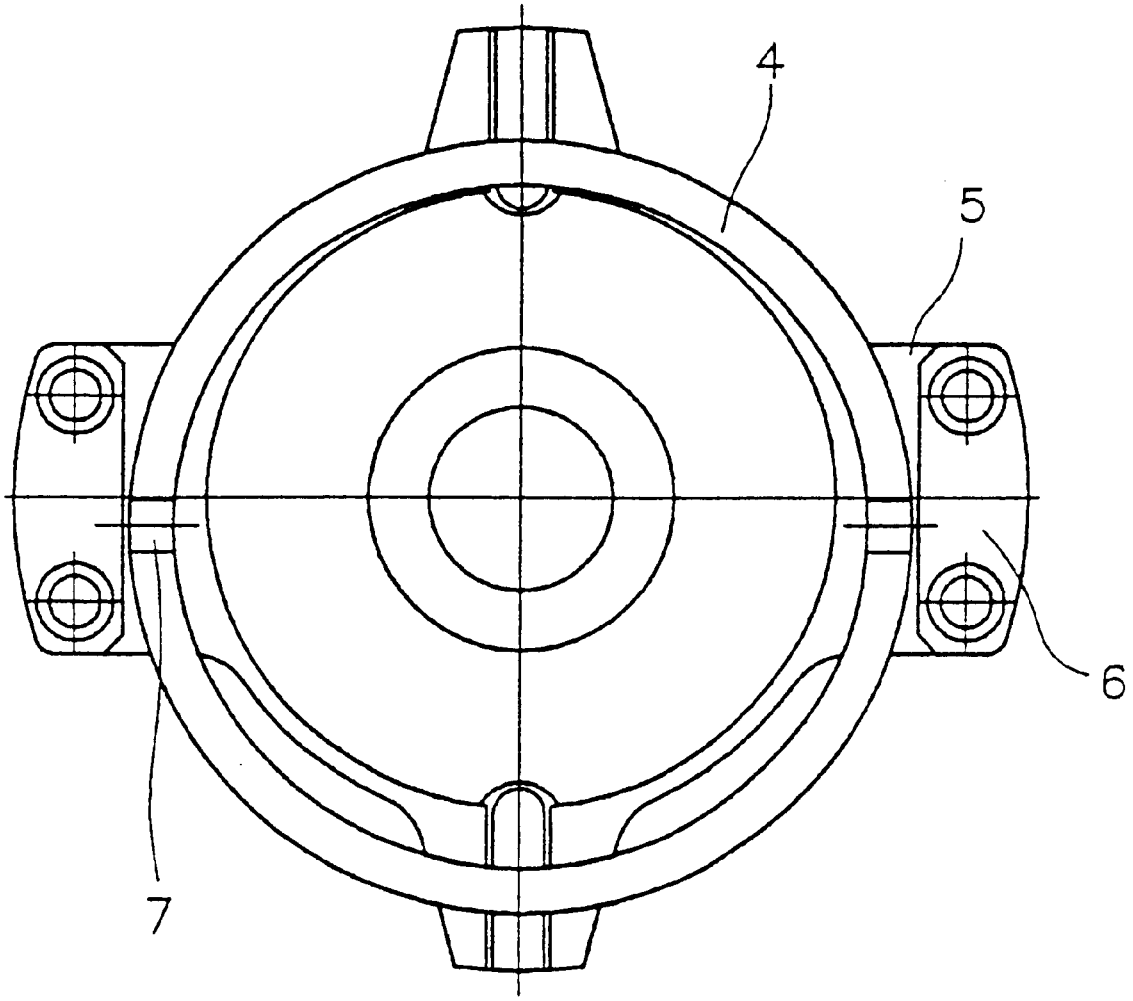
(PRIOR ART) FIG 9
FIG. 9 is a schematic illustration of a conventional Oldham ring together with a frame.

As shown in FIG. 7, the first gilding slots 23 and second gliding elements 41 as well as the third gilding elements 42 and fourth gliding slots 53 each are provided with a groove 411 parallel to the gilding direction. The grooves 411 are at the location, where the first gilding slots 23 and second gliding elements 41 as well as the third gilding elements 42 and fourth gliding slots 53 are engaged with each other, in order to provide for a flow path for lubricating oil, such that mounting oil pressure and energy loss are prevented.

What is claimed is:

1. An Oldham ring system for a rotary fluid compressor, comprising:

a motor shaft;

an eccentric shaft, which is eccentrically mounted on said motor shaft;

a revolving part, which has a disk-like shape and is connected, but not fastened, to said eccentric shaft, with a plurality of blades extending vertically upwards and with two first gliding slots on its lower side located opposite to each other;

a stator, which has a disk-like shape and is mounted above said revolving part, with a plurality of blades extending vertically downwards, corresponding to said revolving part, such that when said motor shaft rotates, said eccentric shaft carries with it the revolving part in a circulating movement while said blades of said revolving part engage with said blades of the stator;

an Oldham ring, installed below said revolving part, said Oldham ring's upper side being provided with two second gliding elements opposite to each other to be engaged with and glide against said two first gliding elements on said revolving part's lower side, and said Oldham ring's lower side being provided with two third gliding elements opposite to each other for a gliding movement perpendicular to the gliding movement between said first and second gliding elements; and a frame, which has a substantially disk-like shape, said frame's center being provided with a hole to accommodate the circulating movement of said eccentric shaft, said frame further being provided with an upwardly protruding inner support around said hole to support said revolving part, two holders opposite to each other on said frame's perimeter, and a flange support between said inner support and said holders to support said Oldham ring, said frame further being provided with two fourth gliding slots opposite to each other in the middle between said holders on said frame's perimeter, for gliding against said third gliding elements;

wherein the improvement is characterized in that the Oldham ring is of circular shape and is, on the two opposite sides located next to said holders of said frame, provided with two straight shortcuts, where the final shape is determined by the following set of equations:

$$R_0 = R_t + r$$

$$R_1 = R_t + t + t$$

$$Ll = 2\sqrt{R_2^2 - (R_1 - X)^2},$$

where $0<X\leqq R_0-R_t$ with $L_1$ being the length of each of said straight shortcuts, $R_0$ being the inner radius of said Oldham ring's circular section, $R_1$ being the outer radius of said Oldham ring's circular section, $R_t$ being the outer radius of said frame's inner support, r being the eccentricity of said eccentric shaft, t being the horizontal thickness of said Oldham ring's circular section, and X being the amount by which each of said straight shortcuts cuts towards the interior of said Oldham ring.

2. An Oldham ring system for a rotary fluid compressor as claimed in claim 1, wherein each of said straight shortcuts on the inner perimeter of said Oldham ring has a length $L_0$ which is determined by the following equation:

$$L_0 = 2\sqrt{R_0^2 - (R_0 - X)^2},$$

where $0<X\leqq R_0-R_t$ $R_0$ being the inner radius of said Oldham ring's circular section X being the amount by which each of said straight shortcuts cuts towards the interior of said Oldham ring, $R_t$ being the outer radius of said frame's inner support.

3. An Oldham ring system for a rotary fluid compressor as claimed in claim 1, wherein said Oldham ring at its inner perimeter is provided with a straight shortcut, corresponding to the two straight shortcuts on said Oldham ring's outer perimeter.

4. An Oldham ring system for a rotary fluid compressor as claimed in claim 3, wherein each of said straight shortcuts on the inner perimeter of said Oldham ring has a length $L_0$ which is determined by the following equation:

$$L_0 = 2\sqrt{R_0^2 - (R_0 - X)^2},$$

where $0<X\leqq R_0R_t$ $R_0$ being the inner radius of said Oldham ring's circular section, X being the amount by which each of said straight shortcuts cuts towards the interior of said Oldham ring, $R_t$ being the outer radius of said frame's inner support.

5. An Oldham ring system for a rotary fluid compressor as claimed in claim 1, wherein said first and second gliding elements as well as said third and fourth gliding elements each are provided with a groove in the gliding direction to provide for a flow path for lubricating oil.

6. An Oldham ring system for a rotary fluid compressor as claimed in claim 5, wherein said grooves are cut into one of each pair of said first and second gliding elements and into one of each pair of said third and fourth gliding elements.

* * * * *